US005676438A

United States Patent [19]

Jeong

[11] Patent Number: 5,676,438

[45] Date of Patent: Oct. 14, 1997

[54] EARTH SYSTEM FOR A WINDOW-TYPE AIR CONDITIONER

[75] Inventor: Ju Yeul Jeong, Seoul, Rep. of Korea

[73] Assignee: Samsung Electronics Co., Ltd., Suwon, Rep. of Korea

[21] Appl. No.: 755,452

[22] Filed: Nov. 22, 1996

Related U.S. Application Data

[63] Continuation of Ser. No. 374,697,

[30] Foreign Application Priority Data

Jun. 15, 1993 [KR] Rep. of Korea ..... 1993-10494 U

[51] Int. Cl.[6] ..... A47B 81/00

[52] U.S. Cl. ..... 312/101; 312/236; 62/262; 174/51

[58] Field of Search ..... 312/100, 101, 312/236, 223.1, 334.27, 350; 174/50, 51; 62/262, 298; 454/201

[56] References Cited

U.S. PATENT DOCUMENTS

| | | | |
|---|---|---|---|
| 2,638,755 | 5/1953 | Borgerd | 312/101 X |
| 2,978,973 | 4/1961 | Sweedyk et al. | 62/262 |
| 3,665,727 | 5/1972 | Mather | 62/262 |
| 3,729,950 | 5/1973 | Astrom | 62/259.1 |
| 3,838,580 | 10/1974 | Ballard | 62/262 |
| 3,992,897 | 11/1976 | Loos | 174/51 X |
| 4,449,766 | 5/1984 | Shook | 312/334.27 |
| 4,961,712 | 10/1990 | Schwenk et al. | 439/436 |

FOREIGN PATENT DOCUMENTS

| | | | |
|---|---|---|---|
| 1342594 | 1/1974 | United Kingdom | 174/51 |

*Primary Examiner*—Peter M. Cuomo
*Assistant Examiner*—James O. Hansen
*Attorney, Agent, or Firm*—Burns, Doane, Swecker & Mathis, L.L.P.

[57] ABSTRACT

A window air conditioner includes an electrically grounded outer case and an air conditioning unit (compressor, condenser, evaporator, etc.) slidable into and from the outer case. Mounted in the outer case is a pair of horizontal metallic rails upon which the unit slides. The rails include sharp projections extending upwardly into contact with a metallic base of the unit to cut through a film, such as paint, disposed on the base, in order to make electrical contact with the base. The unit is thus electrically grounded through the base, rails, and outer case.

2 Claims, 3 Drawing Sheets

EARTH SYSTEM FOR A WINDOW-TYPE AIR CONDITIONER

This application is a continuation, of application Ser. No. 08/374,697, filed as PCT/KR94/00071 Jun. 15, 1994 published as WO94/29651 Dec. 22, 1994.

BACKGROUND OF THE INVENTION

This invention is related to an earth device for a window-type air conditioner, and more particularly, to an earth system having a grounding structure causing the outer case to be electrically grounded.

Air-conditioners of the window type generally cool room air, using a refrigerating cycle. The refrigerating cycle includes a compressible refrigerant which is compressed to a high temperature and high pressure state by a compressor, liquified in a condensing unit by the forced cooling of a blower, decompressed while passing through a capillary tube and then absorbs heat from room air while being gasified in an evaporator. At that time, room air intaken by the blower is passed through the evaporator to be cooled and then discharged indoors.

These window-type air conditioners comprise an outer case 10A in a box shape, as shown in FIG. 1, and generally comprise an indoor-side compartment having an evaporator compartment having a compressor and a condenser, and a partition dividing the compartments. The outer case 10A includes a front plate 20 including an inlet portion 21 introducing room air to the evaporator and an outlet portion 22 discharging heat-exchanged air back into the room.

On the other hand, as the general window type air-conditioner lowers room temperature by heat-exchanging refrigerant with room air at the evaporator, moisture contained in room air is condensed by the dewing phenomena. Especially, in the summer season of high humidity, moisture condensed by the evaporator is increased a lot, so the electrical insulating state becomes worse, and the current applied to the compressor leaks through an electric connection point. Further, electrical devices of the air conditioner are shorted at the outer case to discharge the leakage current.

In order to prevent this electric leakage, the conventional air conditioners have a separate grounded line or use a separate metal coupling member to keep the outer case and other parts of the air-conditioner grounded.

The conventional coupling member As shown in the "A" part of FIG. 1, FIG. 2 and FIG. 3, the earth comprises a coupling hole 11 formed on the side walls of the outer case 10A a washer 41 is fitted into the peripheral portion of the coupling hole 11, and a coupling member 40 connecting a unit base 30 with the outer case 10A. Thus, the outer case 10A is electrically connected with the unit base 30, and is grounded.

The typical example of the earth device in the air-conditioner is disclosed to Japanese Utility Model Laid Open No. 60-4826. The earth device includes a grounded line which is detachably connected between an electrical box and an outer case so that the air-conditioner is grounded.

However, the prior earth device has problems that numerous parts are required, its assembling and disassembling steps are troublesome and the manufacturing cost is increased.

SUMMARY OF THE INVENTION

Accordingly, in order to resolve these problems and disadvantages in the prior art, an object of the present invention is to provide an earth system of a window-type air conditioner for facilitating the assembly and disassembly of an outer case with an air-conditioner unit and for simplifying the air-conditioner to be grounded.

Another object of the present invention is to provide an earth system of a window-type air conditioner for reducing the manufacturing cost by achieving a simple construction.

The present invention comprises an electrically grounded sharp protrusion on the upper surface of a rail, which is formed on both sides of the bottom of an outer case, so that the grounded protrusion cuts through a paint film on a metallic base portion of an air-conditioner unit of an outer case with the painting film of the bottom surface, when the air-conditioner unit is inserted into the outer case, thereby grounding the air-conditioner.

BRIEF DESCRIPTION OF THE DRAWING

An embodiment of the invention will now be described by way of example and with reference to the accompanying drawings, in which.

DETAILED DESCRIPTION OF THE PREFERRED EMBODIMENT OF THE INVENTION

Figure 1:
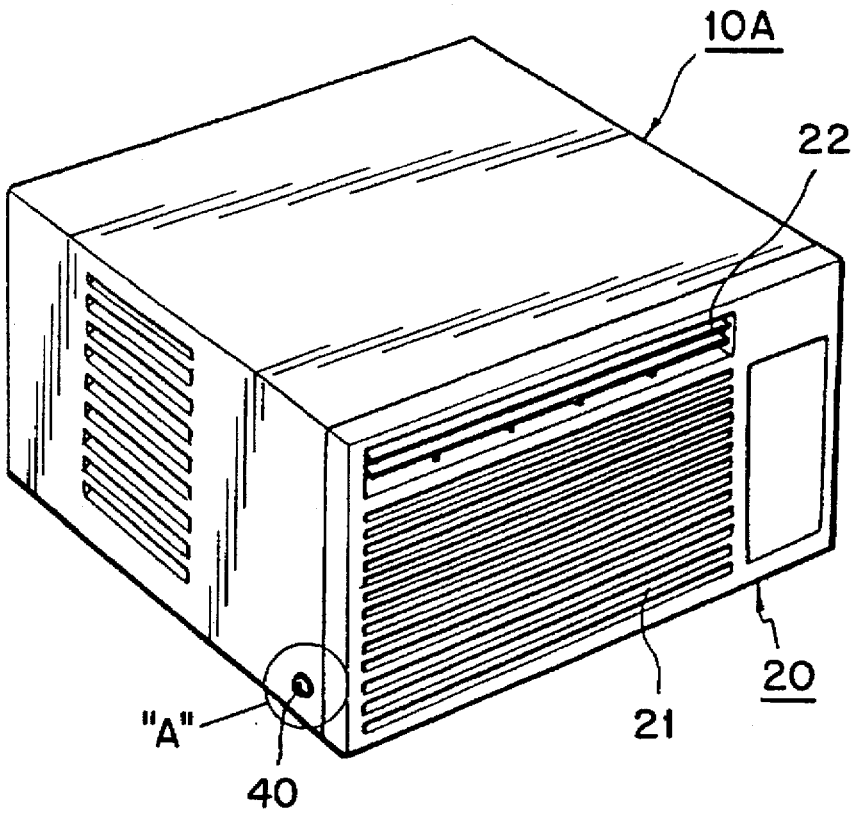
FIG. 1 (PRIOR ART)
FIG. 1 is a perspective view of a prior art window-type air conditioner.
Figure 2:
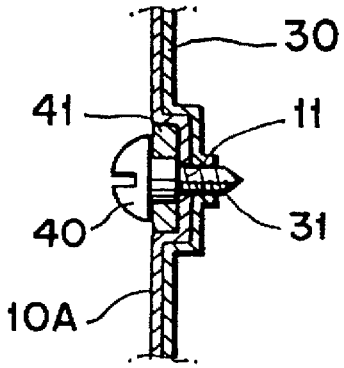
FIG. 2 (PRIOR ART)
FIG. 2 is a sectional view of a conventional earth device in the FIG. 1 air conditioner.
Figure 3:
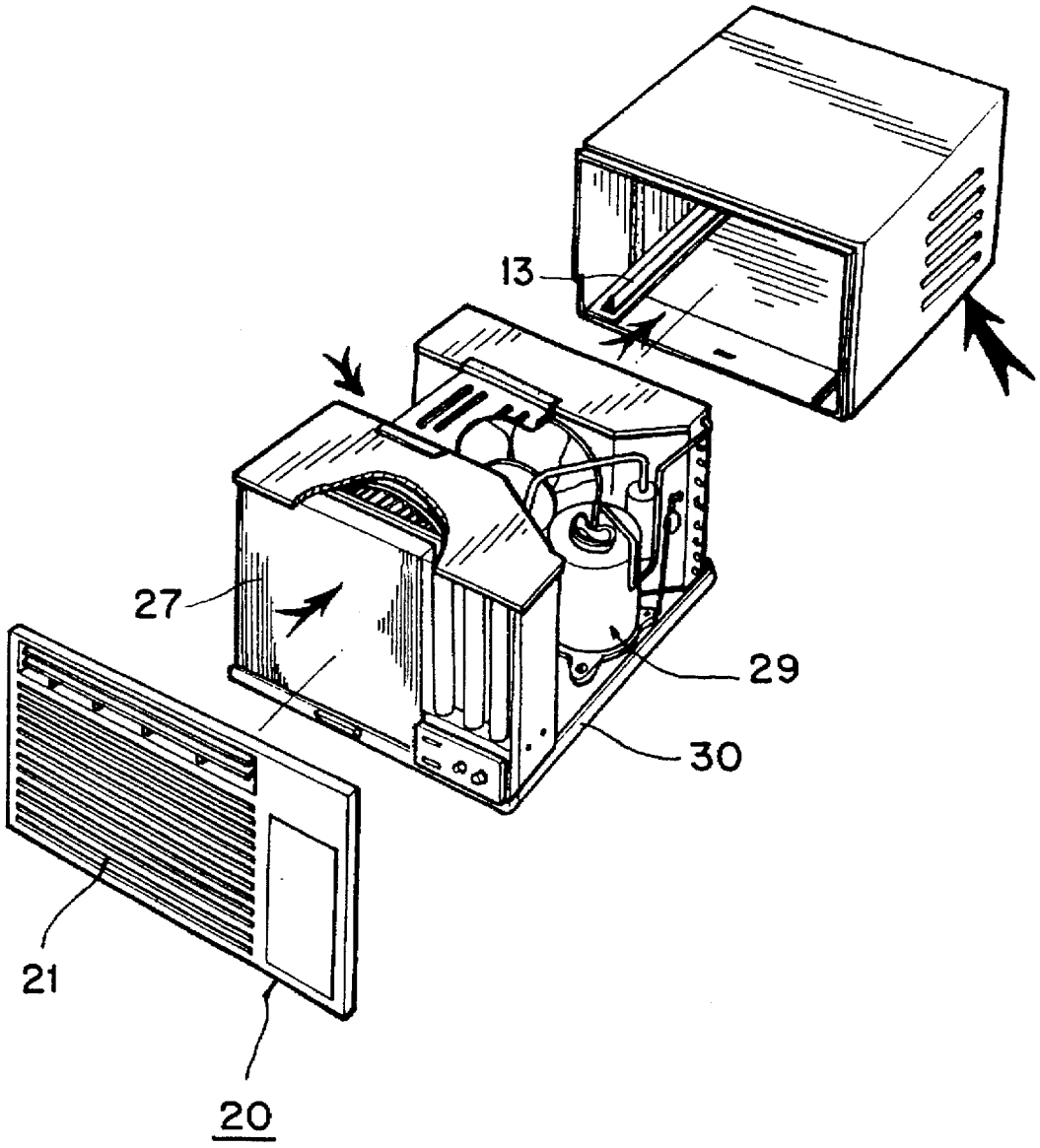
FIG. 3 is an exploded perspective view of a window-type air conditioner according to the invention.
Figure 4:
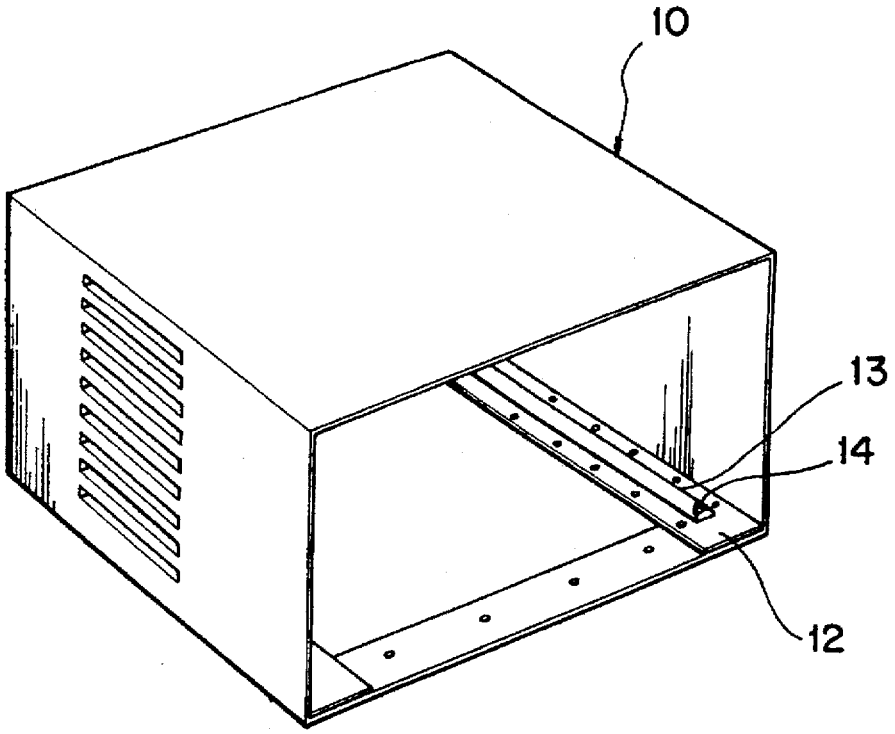
FIG. 4 is a perspective view of the outer case of the FIG. 3 window air conditioner according to the present invention.
Figure 5:
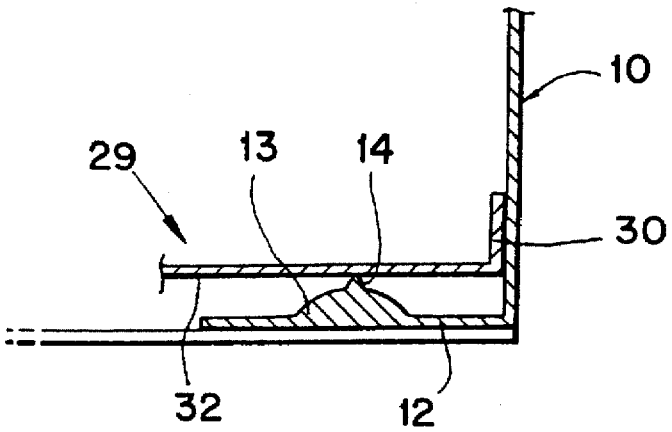
FIG. 5 is a sectional view of an earth system according to the present invention.

The window-type air conditioner depicted in FIGS. 4–5 generally comprises an outer case in the form of a box and an air conditioner unit 29. The air-conditioner unit 10 includes an indoor-side compartment having an evaporator arranged therein and an outdoor-side compartment having a compressor and a condenser arranged therein. The outer case 10 includes a front plate 20 which is provided with an intake 21 for intaking room air and an outlet 22 for discharging heat-exchanged air from the evaporator 27 into the room.

On the other hand, the outer case 10 also includes rails 13 formed longitudinally along support plates 12 the latter being extended inward from both sides of the outer case 10. Each rail 13 is expanded up in a dome shape end enables the air-conditioner unit 29 to be guided forward and rearward in a longitudinal direction, as a bottom surface 32 of a base 30 of the unit 29 contacts the rails 13, thereby detachably being mounted in the outer case 10.

Also, the rail 13 is provided with an upward sharp protrusion 14.

Therefore, the earth system according to the invention functions as follows:

First, the air conditioner unit 29 including the indoor-side compartment and the outdoor side compartment is placed on the rails 13 and is pushed inward toward the rear portion of the outer case 10 along the rails 13, while a painting film formed on the bottom surface 32 of the base 30 is cut out or stripped off by the sharp protrusion 14. At that time, the metal portion of the base 30 becomes electrically coupled with the metal portion of the outer case 10. This creates an electrical contact between the air-conditioner unit 29 and the outer case 10, so that the air-conditioner can be easily grounded, and the leaked current sent to ground during the cooling operation. Alternatively, a plurality of grounded protrusions 14 may be properly formed on rail 13 at the predetermined intervals, thereby achieving the reliable electrical contact.

Accordingly, the grounded protrusion 14 formed on each of the rails 13, electrically connects the base with the outer case, so that the leaked current is easily grounded. Such a simple configuration simplifies the assembly and disassembly of the outer case of the air-conditioner unit and reduces the manufacturing cost of the system.

What is claimed is:

1. A window air conditioner comprising an outer case adapted to be grounded, and an air conditioning unit slidably insertable into said outer case; said outer case including a plurality of rigid metallic rails extending horizontally in longitudinal directions and spaced apart transversely of said longitudinal directions, each rail including a dome-shaped portion and a sharp protrusion projecting upwardly from said dome-shaped portion; said unit including downwardly facing horizontal metallic surfaces arranged to slide longitudinally along respective ones of said rails during insertion of said unit into said case, whereupon said unit is supported by said rails; said rails being electrically connected to said case; said protrusions being of sufficient sharpness to cut through paint film on said surfaces.

2. The window air conditioner according to claim 1 wherein each rail is part of a support plate projecting inwardly from a side wall of said outer case.

* * * * *